US006438877B1

(12) United States Patent
Ruiz

(10) Patent No.: US 6,438,877 B1
(45) Date of Patent: Aug. 27, 2002

(54) ADVERTISING MEDIUM

(76) Inventor: Gabriel Ruiz Ruiz, Avda. Brasil, 30., 28020 Madrid (ES)

( * ) Notice: Subject to any disclaimer, the term of this patent is extended or adjusted under 35 U.S.C. 154(b) by 0 days.

(21) Appl. No.: 09/697,848

(22) Filed: Oct. 27, 2000

(30) Foreign Application Priority Data

Oct. 10, 2000 (ES) ..... 9902712

(51) Int. Cl.[7] ..... G09F 1/00

(52) U.S. Cl. ..... 40/124.04; 40/539; 40/600; 40/124.09

(58) Field of Search ..... 40/124.04, 124.09, 40/124.11, 124.12, 124.13, 539, 594, 600, 672, 673, 674; 283/117

(56) References Cited

U.S. PATENT DOCUMENTS 4,182,063 A * 1/1980 Klosel ..... 40/610
4,200,222 A * 4/1980 Feuer ..... 229/92.8
4,270,291 A * 6/1981 Babberi ..... 40/594
4,319,417 A * 3/1982 Schimmel ..... 40/651
4,323,609 A * 4/1982 Bromberg ..... 428/66.6
5,135,157 A * 8/1992 Cruz ..... 229/92.8
5,303,487 A * 4/1994 Olson ..... 40/124.12
5,458,282 A * 10/1995 Martin ..... 229/92.8
5,487,566 A * 1/1996 Hedge, Jr. ..... 283/56
5,543,190 A * 8/1996 Johnson et al. ..... 428/40.1
5,868,498 A * 2/1999 Martin ..... 383/11
5,918,400 A * 7/1999 Schonberger ..... 40/711
5,983,537 A * 11/1999 Johnson ..... 40/124.04
6,153,280 A * 11/2000 Uffmann ..... 428/43
6,209,924 B1 * 4/2001 Pyle et al. ..... 283/117

* cited by examiner

*Primary Examiner*—William L. Miller
(74) *Attorney, Agent, or Firm*—Brinks Hofer Gilson & Lione

(57) ABSTRACT

Advertising medium, which, being designed to be affixed to a metal or similar surface, and which may have any shape as regards its outline, is essentially characterized by the fact that it is made up of a folded sheet of paper or other suitable material, with two or more sections, one of which holds a magnet while the remaining sections, all decreasing in area, which are positioned behind the side holding the magnet when folded up, have a window of a shape and size complementary to that of the magnet to allow the latter to pass through them and the unit as a whole to be affixed to the respective surface.

18 Claims, 1 Drawing Sheet

ADVERTISING MEDIUM

PURPOSE OF THE INVENTION

The invention refers to an advertising medium of the type that incorporates a magnet so that it can be affixed to a metal surface, but with the peculiarity that it has two or more sections that fold over on themselves, with one of the sections having the magnet and, at least those sections that are superimposed behind the magnet, a window that is complementary to it so that the unit as a whole can be affixed to the metal surface.

The purpose of the invention is to provide the advertising world with a unit of the type intended to be affixed, for example, to the outer surface of a refrigerator door, whose purpose is to act as a means of advertising and at the same time may be used as a means of holding up a page of notes.

BACKGROUND OF THE INVENTION

In advertising, small laminar units or three-dimensional objects of any shape and form are well known, which include a magnet on their back face so they can be affixed to the front of a refrigerator door, so that the unit, whether flat or three-dimensional, is always formed by one single piece with the corresponding magnet and on the visible surface, in the case of being flat, with the respective advertising, while in the case of a three-dimensional figure, it may have the shape of the object that it seeks to advertise.

Evidently, this type of advertising medium allows very limited advertising to be offered, as it cannot contain messages, information or other features, with the advantages and uses and other eventualities that may result from it.

DESCRIPTION OF THE INVENTION

The advertising medium that is proposed, being of the type that is flat by nature and designed to be affixed to a metal surface by means of a magnet duly attached to the unit itself, is characterized by the fact that it has at least two sections that can be folded, one over the other, one of which makes up the cover or front and the other the back, so that the magnet will be located on the back face of the section that makes up the cover or front, while the section that makes up the back will have a window whose shape is complementary to that of the magnet, so that the unit can be affixed to a metal surface, such as a refrigerator door; all in such a way that both the cover or front and its back face, as well as both sides of the back, may be used for advertising material or for any other type of information.

In a preferred embodiment, the unit is made up of at least three sections, one of which will contain the magnet; and the remaining sections, folded up behind the magnet, will have their respective windows, and logically all of the windows will be aligned with each other when the different sections are folded together, to allow the magnet direct access to the surface where it is to be affixed through the opening formed by the windows.

The sections may be folded together in the manner of a flat spiral, where alternating sections are provided with windows, and their area will gradually be reduced so that once the unit as a whole is folded, only the cover or front will be seen, with the peculiarity that the first one has no window and the second has the magnet, all in such a way so that when folded in the manner of a spiral, the second-last section lacking a window makes up the cover or front of the advertising medium, and the last section, along with those that have windows, is positioned so that the magnet on the second section lines up with all these windows, allowing the magnet to be affixed to the respective metal surface.

This method of folding the sections, i.e., rolling them up in a spiral, will produce the final shape of a flat unit whose unfolding will be prevented, and will allow it to be affixed to the metal surface in question by adherence of the magnet, or to another type of appropriate surface if the magnet is replaced by a suitable adhesive element.

The sections may or may not be individually symmetrical, so that in the case where they are symmetrical, the makeup of the die cutting will be the same for each and every one of them, whereas if they are asymmetrical, they may be symmetrical by pairs.

In a variation on this embodiment, the sections may be folded up in zigzag fashion, which would allow an unlimited number of sections to be included, all gradually being reduced in area so that when folded only the cover or front would be seen, where the first one would make up the front or cover and would have the magnet on its back, while the remaining sections, which would be folded in accordion-like fashion, in other words, in the manner of a zigzag, would have their respective windows so that the magnet could go through all of them in order to be affixed to the corresponding surface.

This variation may be provided with a perforated line, on all of the sections, logically in a transverse sense, to allow the sections to be pulled off, the same as pages are separated from a calendar.

In all cases, whatever the number of sections that make up the unit, or whatever the way these sections are folded, there would be as many double sides that could contain information and/or advertising as the unit has sections.

DESCRIPTION OF THE DRAWINGS

To complement this description and for the purpose of allowing for better understanding of the characteristics of the invention, in accordance with the example of its preferred embodiment, a set of drawings of an illustrative and non-restrictive nature, in which the following items are represented, is attached as an integral part of this description.

PREFERRED EMBODIMENT OF THE INVENTION

Figure 1:
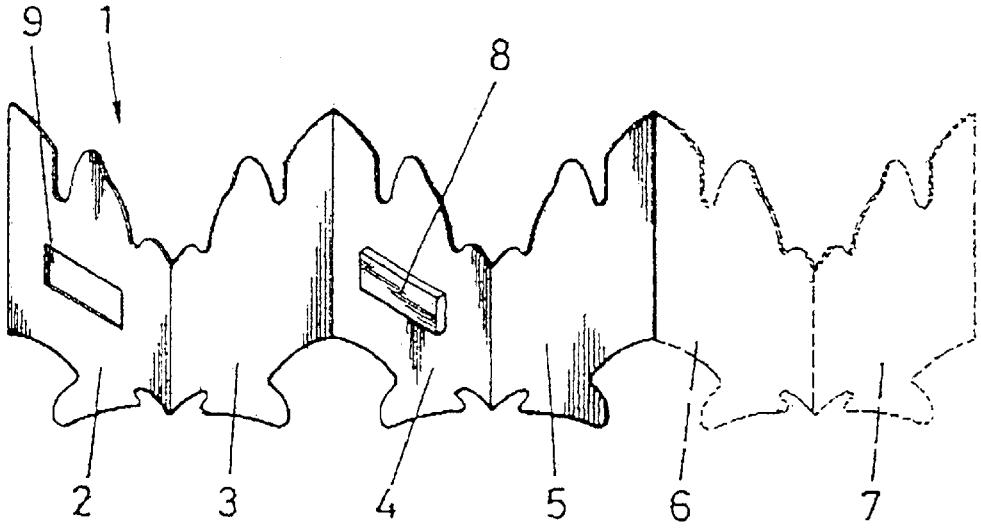
FIG. 1. Shows a representation in the unfolded position of an advertising medium produced in accordance with the object of this invention, ill which the number of sections is unlimited and in which the sections are folded up in spiral fashion.

As can be seen in the above-mentioned figures, and specifically with regard to FIG. 1, it can be seen how the advertising medium referred to in general as (1) is made up of a series of sections (2), (3), (4), (5), (6) and (7), which may be greater or even fewer in number than the aforementioned sections, but always a minimum of three, where section (4) is equipped with a magnet (8), while section (2), which is the first one, is provided with a window (9) which, when the unit is folded up, is to be aligned with said magnet (8) to allow the unit to be affixed to a metal or similar surface. Section (3), located between the aforementioned sections (2) and (4), will make up the cover or front, and section (2) the back, while the remaining sections (5), (6) and (7) will be hidden after folding takes place.

The sections are folded up starting with the last one (7), and they are folded in spiral fashion until section (4) is reached, so that all previous folds are, as a whole, folded against the back face of this section (4), and all of this is folded over the back face of section (3), with this section finally being folded together with section (2) over section (4), with the unit as a whole thus completely folded and with no way of coming unfolded once it is affixed to a surface by means of the magnet (8).

Another way of folding the sections is for alternate sections to have windows, so that the flat spiral can be formed from the first one to the last one, so that those that have a window will be positioned with said windows aligned with each other and behind the magnet (8), while those that do not have windows (9) will be on the opposite side, in other words, in front of the magnet, thus achieving the same result as in the aforementioned case.

Figure 2:
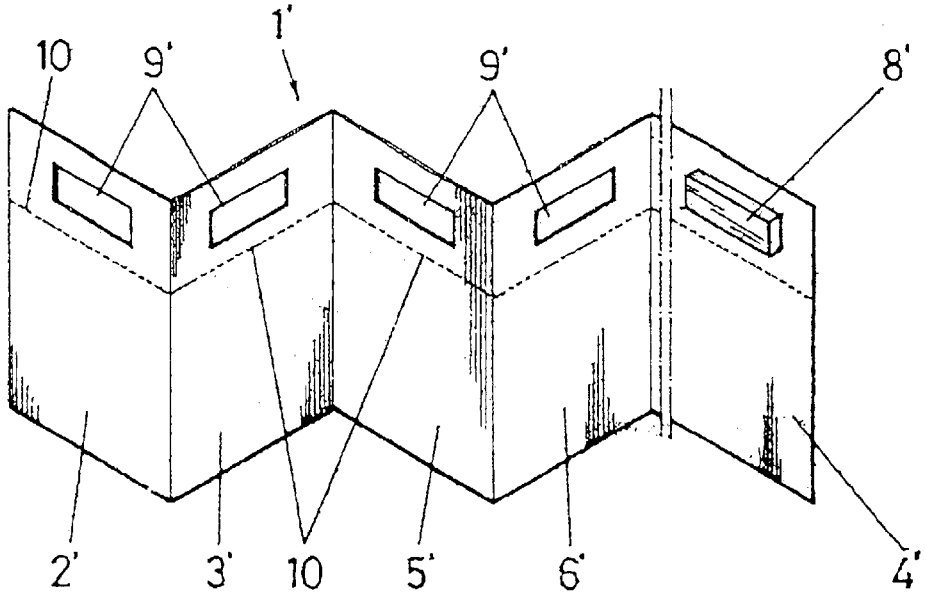
FIG. 2. Shows a variation on the embodiment of the advertising medium, folded up in a different way, in this case in zigzag fashion.

FIG. 2 shows a unit (1') based on multiple sections in which the last one, referenced as (4'), is the one that has the magnet (8'), while the remaining sections (2'), (3'), (5') and (6') are all provided with a window (9'), so that when the unit is folded in zigzag fashion, all the windows are aligned with each other and positioned behind the magnet (8'), so that section (4') will make up the back of the cover and section (2') will, in this case, make up the back, as it will be the last section that is folded, thus completing the folding of the unit as a whole, with no way for it to come unfolded once it is affixed to a surface by means of the magnet.

This variation on the embodiment may have a perforated line (10) in the same position on each of the sections, which allows each of them to be separated by pulling and tearing, as if it were a page from a calendar.

What is claimed is:

1. An advertising medium capable of affixation to a surface comprising:

(a) a folded continuous sheet of material comprising three or more panels, wherein each of said panels is defined by a fold in the medium; and (b) an adhesive element affixed to one of said panels, wherein at least one of said panels directly adjoining the panel affixed to the adhesive element has no opening and at least one of the panels adjoining the panel with no opening contains an opening such that when said continuous sheet of material is folded, said adhesive element and said opening align, such that said adhesive element can affix to said surface.

2. The advertising medium of claim 1, wherein the material comprises at least four of said panels, where both of said panels directly adjoining the panel affixed to the adhesive element have no opening and at least one of said panels directly adjoining the panel with no opening contains said opening.

3. The advertising medium of claim 1, wherein the adhesive element is a magnet.

4. The advertising medium of claim 1, wherein before folding, the sheet is rectangular in shape.

5. The advertising medium of claim 1, wherein the surface is metal.

6. The advertising medium of claim 1, wherein the material comprises paper.

7. The advertising medium of claim 1, wherein the material comprises plastic.

8. The advertising medium of claim 1, wherein the material comprises fabric.

9. The advertising medium of claim 1, wherein the material comprises plasticized or otherwise coated paper.

10. An advertising medium capable of affixation to a surface comprising:

(a) a folded continuous sheet of material comprising three or more panels, wherein each of said panels is defined by a fold in the medium; and (b) an adhesive element affixed to one of said panels, wherein all of said panels not attached to said adhesive element contain an opening such that when said sheet of material is folded, said adhesive element and said opening or openings align, such that said adhesive element can affix to said surface.

11. The advertising medium of claim 10, wherein the panel including the adhesive element is a terminal panel of the sheet.

12. The advertising medium of claim 10, wherein the panels are perforated vertically along the fold and horizontally to allow each of said panels to be independently removed by tearing.

13. The advertising medium of claim 10, wherein the adhesive element is a magnet.

14. The advertising medium of claim 10, wherein the surface is metal.

15. The advertising medium of claim 10, wherein the material comprises paper.

16. The advertising medium of claim 10, wherein the material comprises plastic.

17. The advertising medium of claim 10, wherein the material comprises fabric.

18. The advertising medium of claim 10, wherein the material comprises plasticized or otherwise coated paper.

* * * * *